United States Patent [19]

Martinez

[11] Patent Number: 5,064,200

[45] Date of Patent: Nov. 12, 1991

[54] METHOD OF PLAYING A BOARD GAME

[76] Inventor: Fernando Martinez, 1387 Pennygent, Channelview, Tex. 77530

[21] Appl. No.: 673,009

[22] Filed: Mar. 21, 1991

[51] Int. Cl.[5] ..... A63F 3/00

[52] U.S. Cl. ..... 273/243; 273/249

[58] Field of Search ..... 273/243, 249, 256, 274, 273/276, 273

[56] References Cited

U.S. PATENT DOCUMENTS 4,842,281 6/1989 Turner ..... 273/256

4,889,345 12/1989 Wawryk ..... 273/249

FOREIGN PATENT DOCUMENTS 2214825 9/1989 United Kingdom ..... 273/243

*Primary Examiner*—Bejamin Layno

*Attorney, Agent, or Firm*—Leon Gilden

[57] ABSTRACT

A board game including a playing board, with an outer perimeter track defined by a series of spaces coextensive with the outer perimeter of the game board. A central portion of the game board includes a series of contiguous spaces defining a pyramid configuration, with the uppermost part of the pyramid configuration defined as a goal space, with a gateway space within the perimeter spaces permitting entrance into the pyramid configuration of spaces. Players sequentially utilizing dice members are directed about the perimeter spaces to receive and use playing cards from a deck mounted within the central portion of the playing board. A player being first to deposit an appropriately designated playing card on the goal space is declared a winner or alternatively, depletion of the cards from the deck of cards designates a winner having a greatest number of a designated category of the cards of the deck of playing cards.

3 Claims, 5 Drawing Sheets

METHOD OF PLAYING A BOARD GAME

BACKGROUND OF THE INVENTION

1. Field of the Invention

The field of invention relates to board games, and more particularly pertains to a new and improved board game wherein the same utilizes elements of chance to direct play about a path of spaces, wherein the path of spaces includes a single gateway space, wherein the gateway space directs players into a pyramid of spaces, with a goal space mounted at an uppermost end of the pyramid remote from the gateway space.

2. Description of the Prior Art

Various types of board games are known in the prior art for use and amusement of individuals. Such board games may be found for example in U.S. Pat. No. 4,889,345 to Wawryk wherein a board game includes a plurality of perimeter spaces and a plurality of scattered central spaces within a central portion of the playing board utilizing question and answer cards divided into various categories to direct understanding of an individual identity to be discovered.

U.S. Pat. No. 4,801,148 to Lamb sets forth a military type game wherein a central game board includes wing members hingedly mounted to the game board at a lower terminal end thereof to designate and deploy various moves to the central game board from the wing member.

U.S. Pat. No. 4,900,032 to Erickson sets forth a board game apparatus utilizing a perimeter track and a central track accessed from the perimeter track.

U.S. Pat. No. 4,729,568 to Welsh sets forth a board game analogous to a horse racing event, wherein the game board utilizes a playing field and a start and finish line organization.

U.S. Pat. No. 4,878,675 to Perry, et al. sets forth a game board utilizing an outer and inner perimeter track to permit playing of separate games upon the board organization.

As such, it may be appreciated that there continues to be a need for a new and improved board game as set forth by the instant invention which addresses both the problems of ease of use as well as effectiveness in construction in utilizing chance elements such as dice, and accessing an interior panel of spaces from a perimeter path of spaces to fill in the central spaces with cards drawn from a deck.

SUMMARY OF THE INVENTION

In view of the foregoing disadvantages inherent in the known types of board games now present in the prior art, the present invention provides an board game wherein the same utilizes playing cards distributed to each player as a consequence of directional spaces of a perimeter path of spaces of the game board to subsequently permit access to a central pattern of spaces and utilizing the playing cards to fill in the central panel of spaces based on chance distribution of the cards and of dice members directing travel in the central panel of spaces. As such, the general purpose of the present invention, which will be described subsequently in greater detail, is to provide a new and improved board game which has all the advantages of the prior art board games and none of the disadvantages.

To attain this, the present invention provides a board game including a playing board, with an outer perimeter track defined by a series of spaces coextensive with the outer perimeter of the game board. A central portion of the game board includes a series of contiguous spaces defining a pyramid configuration, with the uppermost part of the pyramid configuration defined as a goal space, with a gateway space within the perimeter spaces permitting entrance into the pyramid configuration of spaces. Players sequentially utilizing dice members are directed about the perimeter spaces to receive and use playing cards from a deck mounted within the central portion of the playing board. A player being first to deposit an appropriately designated playing card on the goal space is declared a winner or alternatively, depletion of the cards from the deck of cards designates a winner having a greatest number of a designated category of the cards of the deck of playing cards.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art board games and none of the disadvantages.

It is another object of the present invention to provide a new and improved board game which may be easily and efficiently manufactured and marketed.

It is a further object of the present invention to provide a new and improved board game which is of a durable and reliable construction.

An even further object of the present invention is to provide a new and improved board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved board game which provides in the methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic top view, somewhat enlarged, of section 4 as set forth in FIG. 1.

FIG. 6 is an orthographic top view, somewhat enlarged, of section 6, as set forth in FIG. 1.

DESCRIPTION OF THE PREFERRED EMBODIMENT

Figure 1:
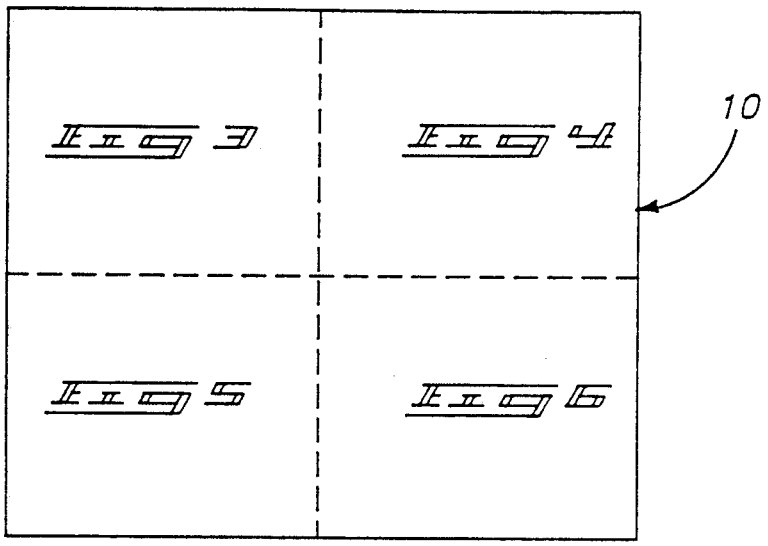
FIG. 1 is a top, plan diagrammatic illustration of the board game of the instant invention.
Figure 2:
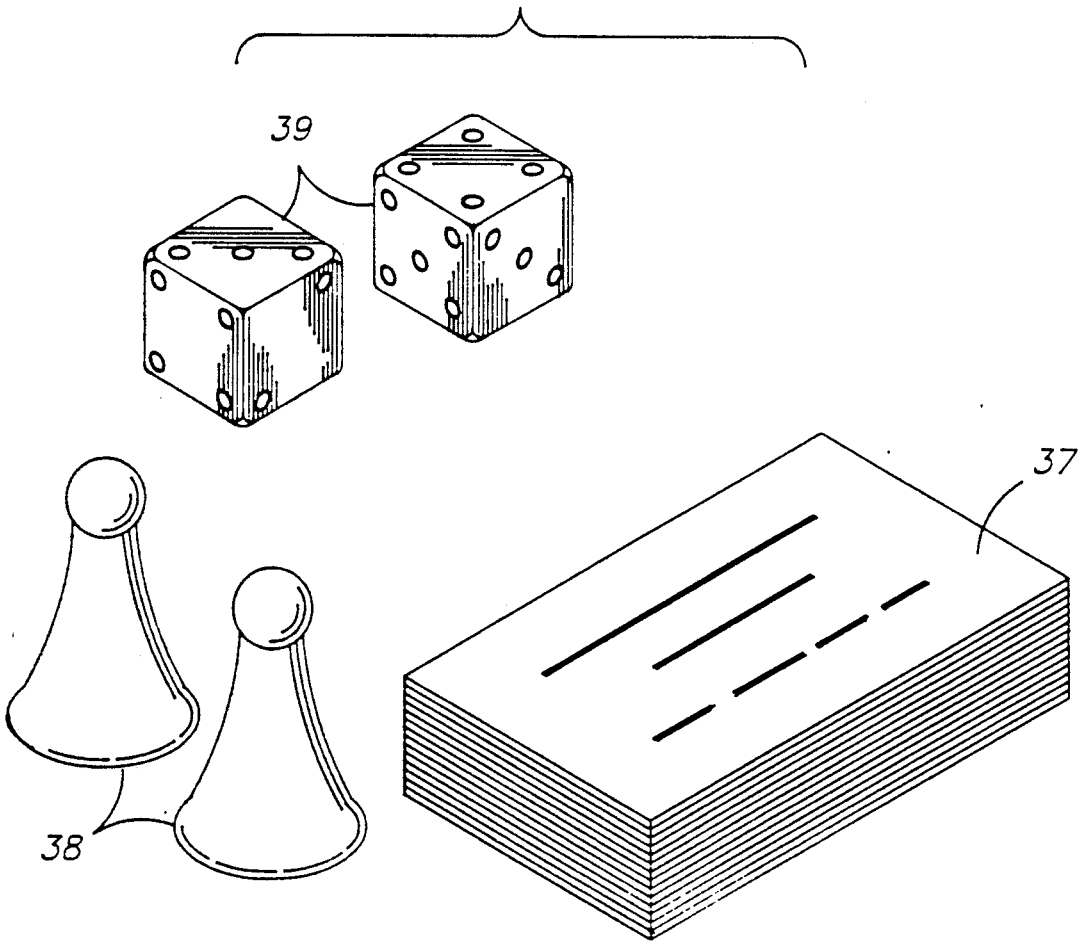
FIG. 2 is an isometric illustration of the dice, tokens, and card deck utilized by the instant invention.
Figure 2:
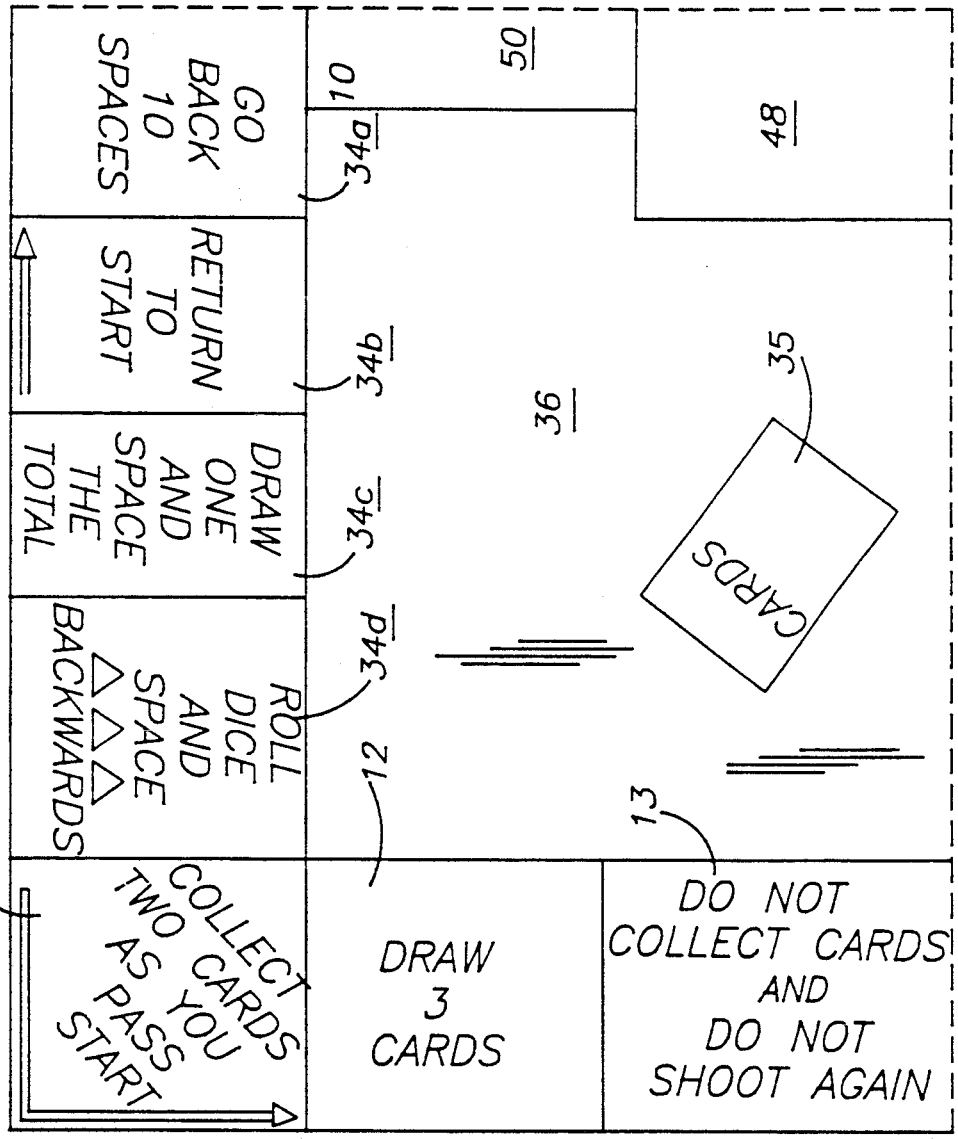
Figure 3:
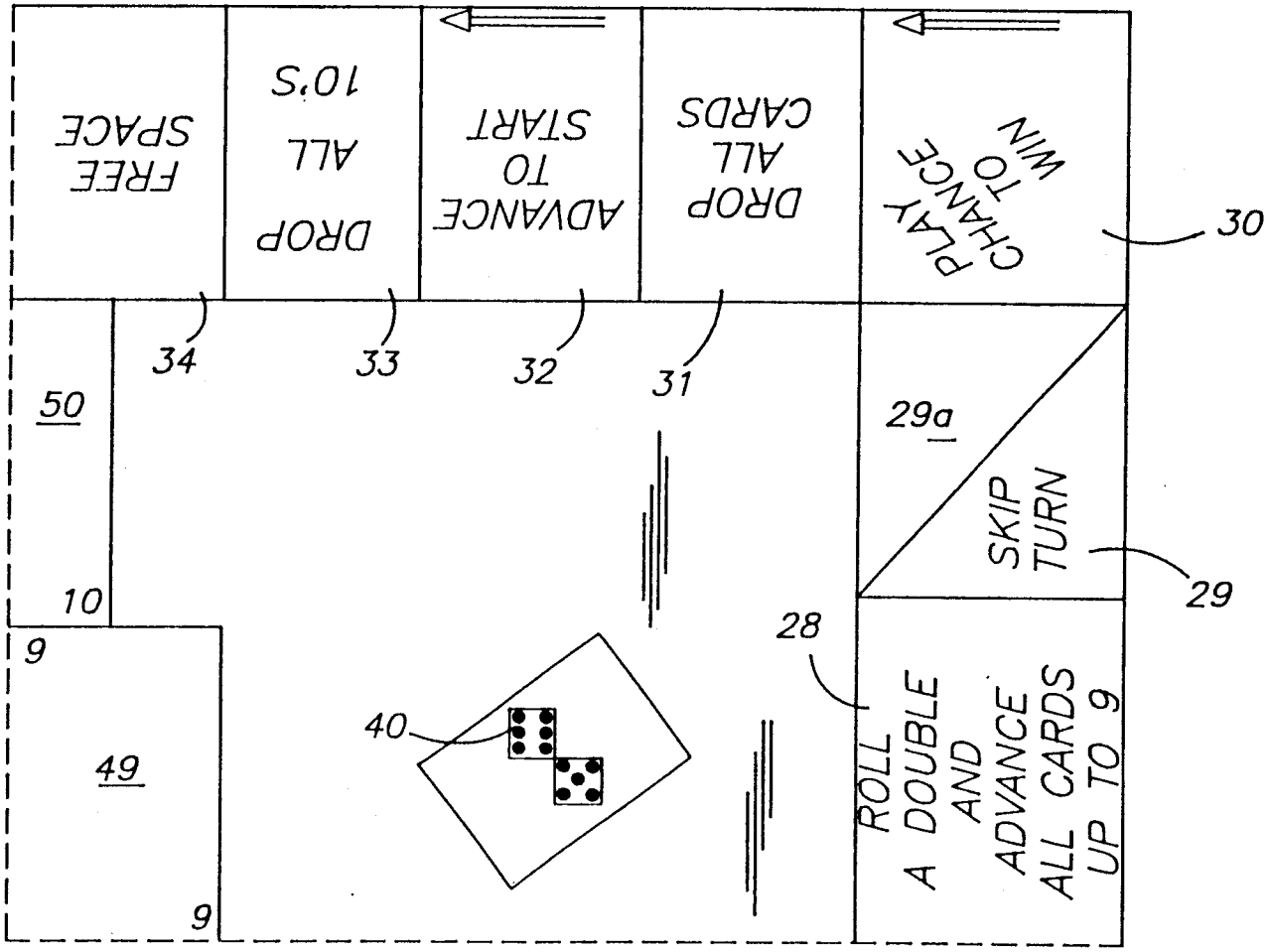
FIG. 3 is an orthographic top view, enlarged, of section 3, as set forth in FIG. 1.
Figure 11:
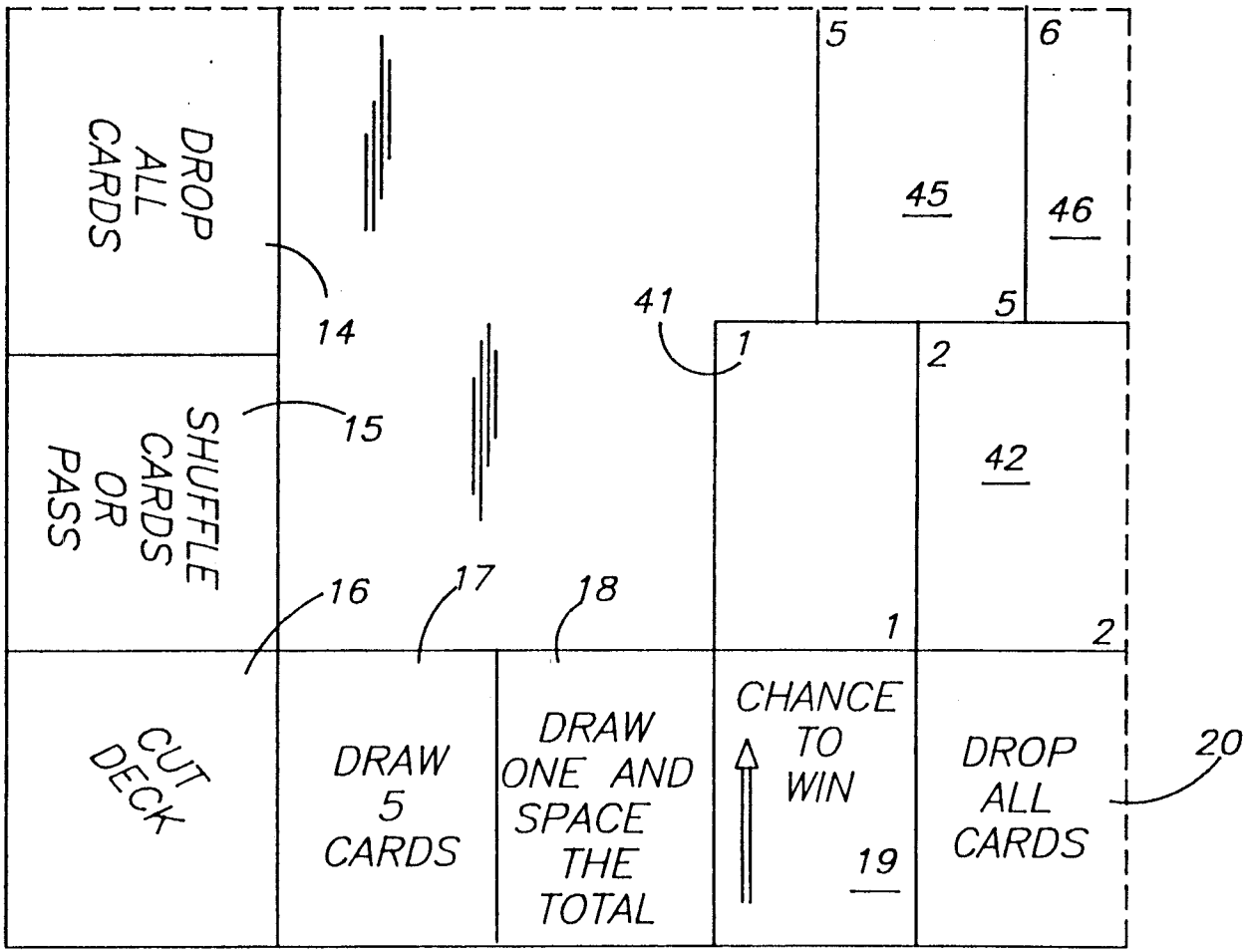
Figure 5:
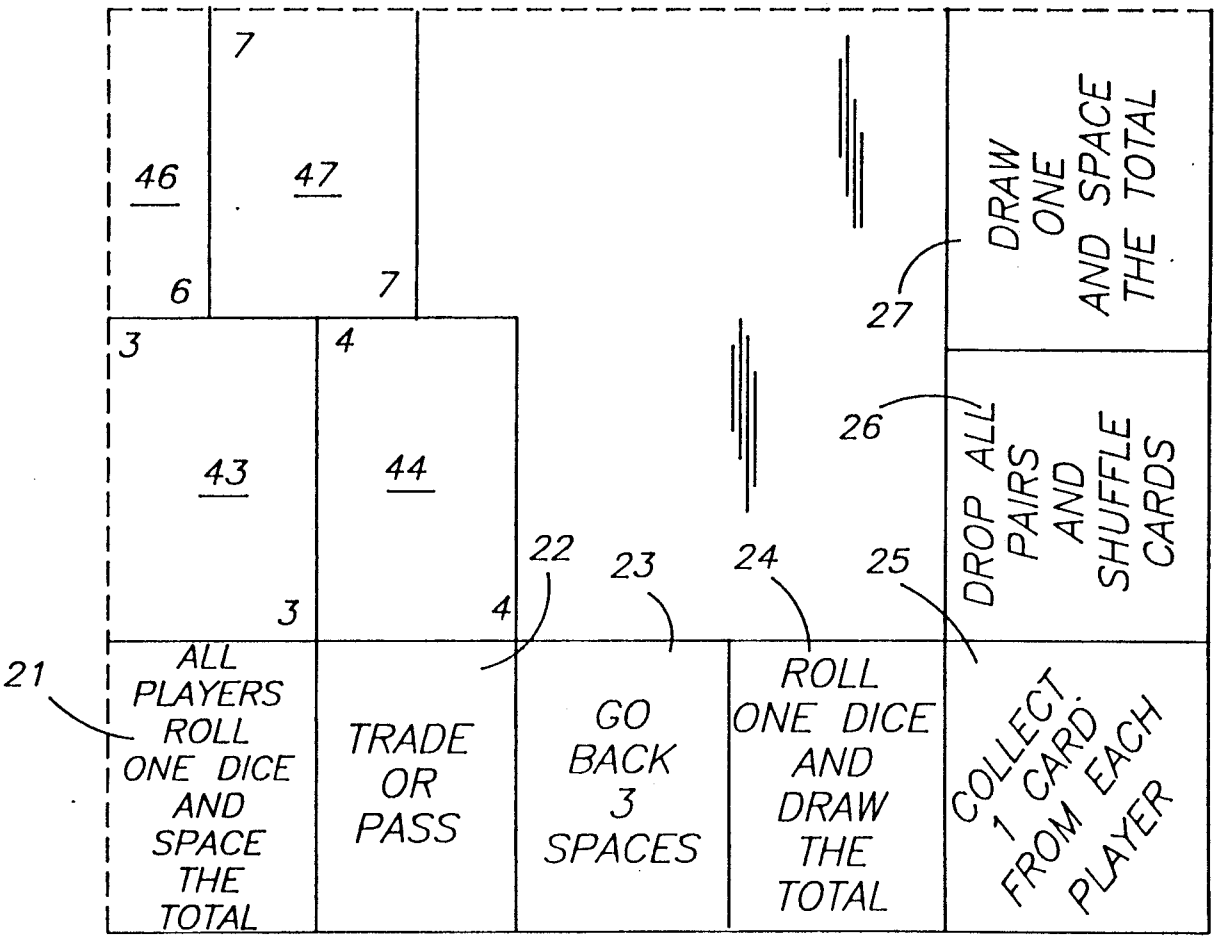
FIG. 5 is a top orthographic view of section 5, as set forth in FIG. 1.

With reference now to the drawings, and in particular to FIGS. 1 to 6 thereof, a new and improved board game embodying the principles and concepts of the present invention and generally designated by the reference numerals 10–50 will be described.

More specifically, the board game apparatus of the invention essentially comprises a playing board 10 of a generally square or rectangular configuration, defining a perimeter path of game path spaces 11–34. A central board space 36 positioned interiorly of the game path spaces includes a playing card deck space 35 for mounting the playing card deck 37 thereon utilizing a bridge-type playing card deck, wherein the numerically designated cards 2–10 are utilized at that valuation to include ten of each Tokens 38 are utilized typically of contrasting colorations, wherein each player utilizes a contrastingly colored token for individual positioning of travel of each player about the playing board 10. A dice pair 39 is utilized and directed into the dice rolling area 40 within the central board space 36. A pyramid (referred to as a myd) of spaces includes the spaces 41–50, wherein the ten spaces are numerically designated 1–10 of the playing field, wherein the tenth space mounted at an uppermost terminal end of the pyramidal configuration is utilized as a goal space. Access to the pyramid of spaces or central spaces is through a gateway space or space number 19 in the playing field.

The game path spaces 11–34 provide various directions in traverse of the perimeter path of game path spaces 11–34 to require each player landing upon such spaces to follow such directions in the drawing of cards, effect forward or rearward movement of a token, lose a turn, and the like, to be described in more detail below.

The object of the game is to position cards by the players in associated and designated spaces 41–50 utilizing like numeral cards 1–10, whereupon the space 50 positioned as the topmost space of the pyramid of spaces is designated as a goal space and is to be filled in lastly by a designated winner that has achieved access to that space and has an appropriate card numbered 10 to position within that space. Alternatively, should, in playing of the game, the deck of cards 35 be depleted, a player having accumulated the greatest number of cards designated as 10 is declared a winner.

At the outset of the game, upon positioning the playing board 10 upon an appropriate support surface, each player upon choosing a token to represent that player is dealt five cards from a deck cards 37, whereupon subsequent to such distribution of cards, the deck is positioned upon the deck space 35 and the game proceeds.

Each player initially positions a respective token on the starting space 11. It should be noted that upon each player traversing the game path spaces and directed back to the start space 11, that player is directed to receive two cards from the deck 37 An initial player is determined by sequentially having each player roll the dice pair 39 and play continues. Play is directed counter-clockwise generally about the path of spaces, whereupon a player rolling a matching number by the dice pair 39 may proceed from that point to enjoy an additional turn. Should a player roll three doubles in a row, the player must put down all cards and proceed to the space 29 or skipping or losing a turn and wait until the next turn. It should be noted that to attain access to the myd (pyramid) of spaces 41–50 through the gateway space 19, that player in a roll of the dice may enter the myd of spaces only upon having a properly numerically designated card to position upon an objective space. For example, should a player be directed through the game path through 19, and the player be directed to the space 42, that player must have a card designed as a "2" from the card deck 37, otherwise that player may not enter the myd or pyramid of spaces 41–50.

Upon entering the myd of spaces 41–50, a player properly positioning a card within one of the designated spaces 41–49 of the numbers 1–9, a player may then collect that total number of cards indicated per the respected spaces 1–9 from the deck and may proceed through the myd in sequential numerical order on a subsequent turn. While in the myd, each time a player lands on a space, and that space has already been presented a card from a previous player, and the landing player is entitled to collect the total amount of cards in that space. However, if a player lands on a space that has not been positioned with a card and does not have a proper card to position that space, that player must at that point drop the card, i.e. put them down for non-play, and move the "skip turn" or space 29. A player being positioned on the skip turn space 29 must position his token on the space mark 29 and upon skipping his turn, the player may then move his token to the other half of the split space indicated as **29*a*** and proceed with the game on a subsequent turn.

In the spaces 18 and 27 for example that indicates a player to draw one card and spaced a total, that player draws a top card from the deck 37 and the numerical designation of the card of the cards 1–10 indicates the spaces that player moves, the player retains the card. Additionally when a player lands on a space such as 18 or 27 with a double, i.e. like indicated numbers of the die pair 37, the player may then roll the die pair again. Similarly, space 21 indicates the player to roll one die member of the die pair 39 and advance the indicated total of that rolled die member forwardly along the perimeter path.

In space 34*c*, where direction is to "draw one" a player draws the top card from deck 37, advances the amount indicated by that card, and retains the card.

Direction of space 28 for example where it is indicated that a player roll a double and advance all cards up to 9, the player upon rolling a double and landing upon the space must retain the dice and advance all cards needed to fill up the myd up to 9. If the player does not have any cards to advance, the player must then proceed with the game, however if a player happens to have all of the cards required to fill up the myd up to 9 and also by chance has a 10, he is then entitled to advance all of the cards and granted the honor of winning the game.

A landing upon a "free space" such as space 34, a player may proceed to any space on the game board along the path, other than the spaces 41–50 of the myd.

A player landing upon space 30 immediately moves his token to space 19, or the gateway space, collects two cards from the deck 37 for passing the starting position 11.

Landing on the space 34*b*, or returning to "start", must be returned to space 11 without collecting any cards or playing any of the spaces therebetween until he reaches the point where he has passed before to begin play anew. Should another player happen to pass that same point, such as space 34*b*, prior to the first player returning, the further player is entitled to collect cards on that space that the first player had to deposit on the return to the start 11. In other words, the thusly deposited cards on the space 34*b* are there for the taking of a first player to land on that space 34*b*.

The space 25 indicating a collection of a card from each player is self-evident but should a player not have any cards to give, the collecting player must then draw from the deck 37 to replace that unavailable card.

In the space such as 20, indicating to "drop all cards", the player must immediately position all of the cards on the bottom of the deck and lose these cards. Spaces 14 and 31 are of such direction, wherein space 33 merely directs each player thusly landing to return all of the "10's".

In the space 22 for example that directs a player to "trade or pass", a player may trade cards in his possession with the cards of the deck 37. Once a player has replaced all of the cards of the bottom of the deck, the player must then draw the total amount of cards he has had and shuffle the deck prior to playing the cards. Should a player forget to shuffle, the next player then throws the dice pair 39, the trading player must then deposit all cards and await further turn for proceeding along the perimeter game path.

The space 34*d* indicating to "roll a dice and space backwards" indicates a player to roll one of the dice members 39 and space that amount backwards clockwise along the perimeter path until he lands on a space which will indicate a further move. Rolling a double is excluded on this space.

In the space 24 that indicates to "roll one dice and draw the total", a player must roll one die and draw that total number of cards from the deck 37.

The space 15 indicating to "shuffle the cards or pass" tells the player to shuffle the cards of the deck 37 at his discretion.

Space 13 indicates to "do not collect cards and do not shoot again" the player may not collect the two cards for passing the starting position 11 and may not throw the dice until a subsequent turn.

Spaces such as 17 and 12 indicated to draw a predetermined group of cards in addition to any cards that may be available to that player for passing the start position 11.

Space 16 indicates a player to "cut the deck", i.e. deck 37, may cut a deck and proceed on with the game but should that player forget to cut the deck, the next player rolls the die pair 39 and the player forgetting to cut the deck must move to space 29 to skip a turn. Spaces 21 and 24 indicate players to roll one of the dice members 39 and either advance that number of spaces or alternatively, draw the determined number of cards indicated by the die member respectively. A player landing upon space 32 or "advance to start" moves his token to the starting position 11.

The space 26 indicates players to "drop all pairs and shuffle cards" removes all paired numbers of cards from a hand and places them at the bottom of the deck and shuffle the deck. Should that player forget to shuffle, the next player takes a turn the player forgetting to shuffle must hand over all remaining cards to the next player and move his token to the skip turn space 29. The next player must the shuffle the deck to be entitled to the remaining cards.

Optional Rules

To begin an optional period, all players must place their tokens in the space marked start or space 11 for a short game. Each player is given ten consecutive cards. Once all cards are distributed to the players, each player then rolls the dice to determined which player will initiate play. Each player must roll an eight to immediately advance his token to the space marked 19 or "chance to win". Once a player is first to reach this space 19, that player is given the privilege of inserting a first card (i.e. No. 1) on the space 41. A player may enter the pyramid of spaces 41–50 if that player throws the exact amount of spaces not inserted with a card. Once a player has entered the myd and inserted the appropriate card, the player may then proceed upward or downward along the myd, but may not land on a space that has already been positioned with a card. If a player happens to roll the same amount of the card he has inserted, the player then immediately moves his token back to the space marked 19 or "chance to win". He proceeds again into the myd on a subsequent turn. In the case that player not being able to proceed upward or downward as a result of his throw, that player must remain on that space and await a subsequent turn. Once all cards have been inserted up to nine, or spaces 41–49, all players must strive to throw the proper roll of the die members 39 to permit access to space 50 to insert the winning card 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of playing a board game comprising the steps of providing a game board, and providing a perimeter path of spaces defining a playing path along a perimeter of the game board, and designating a single space for a start space and designating a further space as a gateway space, and providing a further plurality of spaces on the game board interiorly of the playing path, with the further plurality of spaces in communication only with the gateway space to permit entrance into the further plurality of spaces through the gateway space and exit from the further plurality of spaces through the gateway space, and providing a token for each player, and providing a plurality of dice for directing the token for each player about the playing path and the further plurality of spaces, and further providing a deck of playing cards and designating individual cards within the deck of playing cards from 1–10, and designating the further plurality of spaces 1–10 wherein each player is provided a predetermined number of playing cards and each player is directed to position the predetermined value of playing cards of the playing cards 1–10 upon a space of the further plurality of spaces of like designation of 1–10, and wherein the players must initially fill the further plurality of spaces 1–9 with a like designated playing card prior to positioning of the playing card designated as 10 upon a further space designated as 10.

2. A method as set forth in claim 1 wherein directional spaces are provided in the playing path between the start space and the gateway space, and the directional spaces direct players to draw or replace cards relative to the deck of playing cards permitting players to obtain playing cards for filling the further plurality of spaces from 1–10.

3. A method as set forth in claim 2 wherein the method includes directing play to continue until each of the further plurality of spaces is filled and directing a first player to fill a further space designated as 10 as a winner, and providing directions to alternatively continue play until playing cards from the deck of playing cards are completely distributed whereupon a player is declared a winner who has a greatest number of playing cards designated as 10.

* * * * *